United States Patent [19]

Chang et al.

[11] 3,964,875

[45] June 22, 1976

[54] SWIRL EXHAUST GAS FLOW DISTRIBUTION FOR CATALYTIC CONVERSION

[75] Inventors: Zung S. Chang, Painted Post; John S. Howitt, Big Flats; Robert V. VanDewoestine, Corning, all of N.Y.

[73] Assignee: Corning Glass Works, Corning, N.Y.

[22] Filed: Dec. 9, 1974

[21] Appl. No.: 530,658

[52] U.S. Cl. ..... 23/288 FC; 23/288 F; 23/288 R; 138/40; 138/42

[51] Int. Cl.[2] ..... B01J 8/02; B01J 35/04; F01N 3/15; F15D 1/00

[58] Field of Search ..... 23/288 F, 288 FC, 288 R; 138/39, 40, 42

[56] References Cited

UNITED STATES PATENTS

| | | | |
|---|---|---|---|
| 1,152,381 | 8/1915 | Kenney | 138/40 UX |
| 1,985,713 | 12/1934 | Bartlett | 23/288 FC UX |
| 2,717,049 | 9/1955 | Langford | 55/DIG. 30 |
| 2,878,789 | 3/1959 | Huet | 23/288 FC UX |
| 3,027,143 | 3/1962 | Furgerson et al. | 138/39 |
| 3,111,963 | 11/1963 | Brockwell | 138/39 |
| 3,258,895 | 7/1966 | Wiebe | 55/233 |
| 3,749,130 | 7/1973 | Howitt et al. | 23/288 FC UX |
| 3,780,772 | 12/1973 | Carnanhan et al. | 23/288 FC UX |

*Primary Examiner*—Morris O. Wolk
*Assistant Examiner*—Michael S. Marcus
*Attorney, Agent, or Firm*—Burton R. Turner; Clarence R. Patty, Jr.

[57] ABSTRACT

In an exhaust system for an internal combustion engine, wherein pollutants are removed from the exhaust gases by catalytic conversion, a pinwheel type of deflector positioned within the exhaust flow provides a radially-outwardly deflected swirl flow to the gases as they emanate from an exhaust pipe of one diameter into a canister of larger diameter for housing a catalytic converter. Such flow distribution results in improved catalytic conversion efficiencies obtainable by the converter and reduces its degradation rate inherent with time.

4 Claims, 8 Drawing Figures

10
12
10
10
12
16
14
18
18
14
18
16
20

30
32
34
36
38
40
42
44
46
22
24
20
28
A
B

SWIRL EXHAUST GAS FLOW DISTRIBUTION FOR CATALYTIC CONVERSION

BACKGROUND OF THE INVENTION

This invention pertains to the automotive emissions control art, and more particularly to a method and apparatus for deflecting or redistributing the flow of exhaust gases discharged from an exhaust pipe into a canister or housing containing a coated honeycomb monolith of a catalytic converter of larger cross-sectional area than the exhaust pipe, so as to more evenly distribute such discharge flow through such catalyzed honeycomb support member within the container, and thereby optimize the treatment and removal of pollutants from said exhaust gases.

When attempting to remove pollutants from exhaust gases being emitted from the exhaust pipe of an internal combustion engine by passing such gases through a suitable catalyst support of larger cross-sectional area than the exhaust pipe, it has been found that the high velocity kinetic energy of the exhaust gas stream does not dissipate when passing from the relatively small diameter exhaust pipe into the catalyst support chamber of substantially larger diameter. Accordingly, the high velocity gases tend to merely flow through the center of the catalyst support, with a rather small proportion passing through the remainder thereof, thereby materially reducing the overall potential efficiency of the catalytic converter.

A common method of obtaining a uniform flow front has been to utilize a long frusto-conical diffuser when making a transition from a small diameter passageway to one of substantially larger cross section. A diffuser having an included angle of about 11° would be ideal for maximizing the conversion of stream kinetic energy to potential energy and maintain a substantially even flow front, however, in the case of an automobile exhaust system, such a diffuser would be impractical due to the length which would be required to make such a transition. Accordingly, the present invention not only provides a substantially improved flow distribution of the exhaust gases across the face of the catalytic converter, thus providing improved efficiencies, but also accomplishes such end with a novel compact structure which is easy to fabricate and install.

SUMMARY OF THE INVENTION

A pinwheel-type deflector member is positioned within a high velocity exhaust stream at a location adjacent to where such exhaust stream is discharged from a conduit of one diameter into one end of a large angle diffuser, which is connected at its opposite end to a conduit or cylindrical container of a larger diameter. The pinwheel deflector member functions to distribute the flow from the exhaust pipe or conduit by imparting a tangential or swirling velocity component to the exhaust gases entering the diffuser. As a result, the exhaust gases discharged longitudinally from the confines of the smaller diameter conduit are redistributed radially outwardly with a swirl action so as to provide an improved flow front for optimizing the efficiency of a catalytic converter positioned within the larger diameter conduit connected to the smaller diameter conduit by the wide angle diffuser.

An object of the invention has been to provide means for deflecting the flow of high velocity exhaust gases entering a relatively large diameter catalytic treatment chamber from a relatively small exhaust conduit so as to dissipate the high center of velocity and redistribute the flow of gases to produce a more desirable flow front as such gases approach a flow-through catalytic converter within said treatment chamber.

DESCRIPTION OF THE PREFERRED EMBODIMENTS

Figures 1, 1A, 2, 2A, 3:
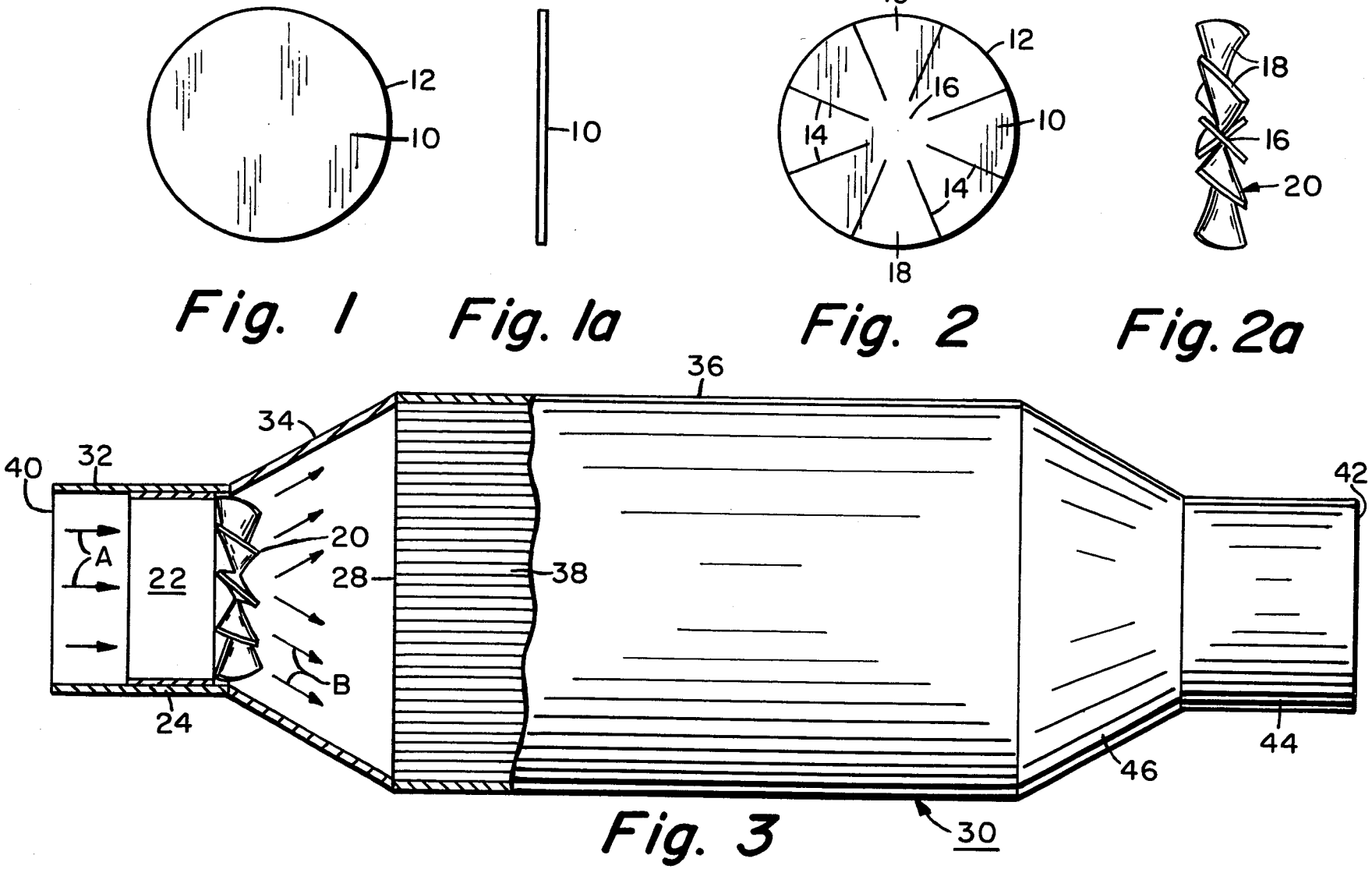
FIG. 1 is a plan view of a blank for forming a pinwheel flow deflector of the present invention.
FIG. 1*a* is an elevational view of the blank shown in FIG. 1.
FIG. 2 is a plan view of the blank shown in FIG. 1 having been slit-cut into a plurality of vanes.
FIG. 2*a* is an elevational view of the slit-cut blank shown in FIG. 2 wherein the vanes have been twisted approximately 45°.
FIG. 3 is an elevational view, partially in section, illustrating a portion of an exhaust system containing a pinwheel deflector of the present invention.

Referring now to FIGS. 1 and 1*a*, a sheet of material 10 is cut, stamped or otherwise machined with an outer peripherial configuration 12 similar in size and shape to the exhaust conduit in which a deflector is to be positioned. The sheet 10 is preferably formed into a disc shape as shown by the circular periphery 12. The sheet 10 may be of any suitable material which will withstand the corrosive high temperature exhaust gases of an internal combustion engine, including various steel alloys such as stainless steel.

Referring now to FIG. 2, the disc-shaped sheet 10 is provided with a plurality of slits, slots, or saw cuts 14 extending radially inwardly from the periphery 12 to a central core portion 16, forming a plurality of vanes 18. As shown in FIG. 2*a*, the vanes 18 are uniformly twisted with a desired angle relative to a plane extending through said core portion 16 perpendicular to the axis of said disc 10. Accordingly, the plurality of vanes 18 produce a pinwheel-type deflector 20 with the vanes extending radially outwardly from a central core portion 16 at a desired angle for imparting a swirl-like flow to the exhaust gases passing therethrough.

Referring now to FIG. 3, a pinwheel deflector 20 is shown positioned within an exhaust system 30, including an exhaust pipe 32, a diffuser 34, and a cylindrical housing or canister 36 which contains a coated honeycomb catalyst support or substrate 38. The exhaust system as shown has an inlet end 40 which is fed by the exhaust pipe 32, and an outlet end 42 forming the exit opening of a tailpipe 44 connected to the canister 36 by means of a frustoconical connector 46.

The pinwheel deflector 20 is preferably positioned so as to be substantially within the inlet opening of the diffuser 34, and may in fact be positioned at the intersection of the exhaust pipe 32 and diffuser 34. The vanes 18 of deflector 20 may be secured to the end of a mounting ring or collar 22, such as by tack welding. The mounting ring is positioned within and secured to a discharge end portion 24 of the exhaust pipe 32. As shown, exhaust gases represented by arrows A entering the diffuser 34 are deflected radially outwardly from a central axis extending through the exhaust pipe 32, diffuser 34 and housing 36 in a swirling action across the entrance face 28 of catalyst support 38, as shown by arrows B, to provide a more uniform flow distribution to the face 28.

Figure 4:
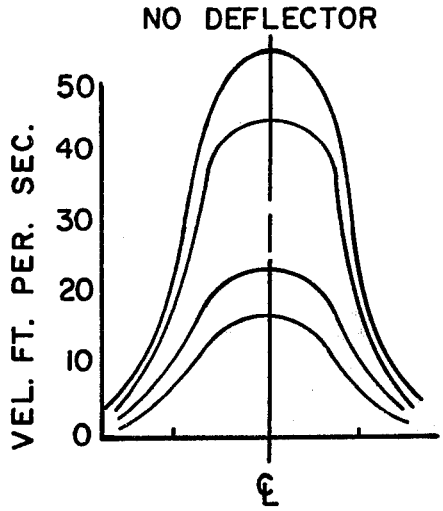
FIG. 4 is a graph illustrating the flow profile of exhaust gases at various velocities entering a treatment chamber from an exhaust pipe having no deflector.
Figure 5:
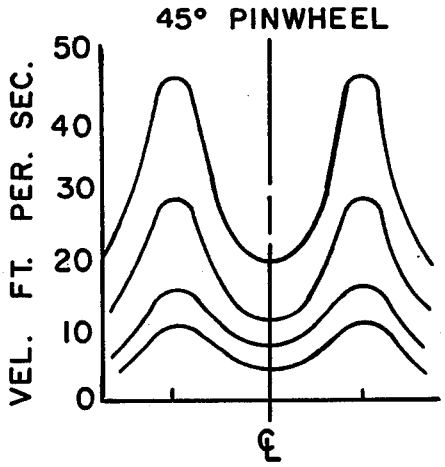
FIGS. 5 and 6 are graphs similar to that shown in FIG. 4, illustrating the flow profiles obtained when a 45° pinwheel deflector and a 60° pinwheel deflector, respectively, are inserted in the exit end of the exhaust pipe.
Figure 6:
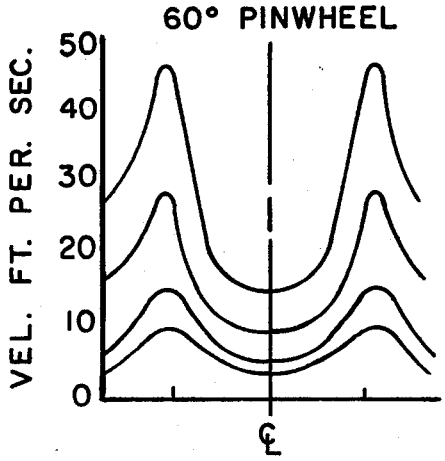

Referring now to FIGS. 4, 5 and 6, a plurality of flow patterns or flow profiles are shown for various deflector conditions as may be obtained with the system shown in FIG. 3, with and without deflector devices. In addition, four profile or flow fronts, representing various flow velocities, are shown for each of the illustrated conditions. In FIG. 4, which represents the flow profile obtained when no deflector is utilized, it will be noted that the largest velocity is concentrated along the center line of the housing 36 or centrally of the entrance face 28. It is thus apparent that very little if any appreciable gases will flow through outer peripheral areas of the substrate 38 contained within the container 36 when no deflector is utilized in the system. Accordingly efficiencies of the catalytic converter are materially hindered when no deflector is utilized, since the exhaust gases are concentrated in the central area of the converter resulting in substantially less than maximum possible utilization.

FIG. 5 illustrates the flow profile obtained when utilizing a 45° pinwheel, whereas FIG. 6 illustrates the flow profile obtained when utilizing a 60° pinwheel. It thus can be seen that by adjusting the width of the slots 14 between the vanes 18, and the angle of the vanes, various flow distributions can be obtained by imparting a swirl in the gas stream and generally deflecting it away from the center of entrance face 28 of the substrate 38 so as to provide a more uniform flow distribution and more full utilization of the entire substrate. It will be noted through a comparison of FIGS. 5 and 6 that the amount or gradient of outward deflection can be increased by increasing the angle of the vanes 18 from 45° to 60°, whereas a lesser outward deflection is obtained when utilizing a 30° pinwheel. Further, it is also apparent from FIGS. 5 and 6 that the flow velocity within an annular area concentrically remote from the centerline is greater than that along the center line or central axis of the flow housing. As also shown by FIGS. 4, 5 and 6, the velocity distribution for each condition becomes more exaggerated as the flow velocity increases from a low velocity toward a high velocity, with the more uniform middle profiles being representative of actual exhaust discharge flows.

The following table sets forth steady rate conversion efficiency between a 30° pinwheel and its control at zero hours, 149 hours, 371 hours and 450 hours; as well as that of a 45° pinwheel and its control at zero hours, 150 hours, 275 hours and 450 hours.

As will be noted from the foregoing Table, the steady state conversion efficiency results obtained before aging show that the pinwheel devices improve the oxidation of CO and hydrocarbons over the control samples. Further, Table I indicates that the margins of superior operation continue to widen as a result of aging, with CO improvements, initially about 2% to 5%, increasing to a maximum of about 15% in the case of the 45° pinwheel. Likewise, hydrocarbon efficiency, which at zero hours shows 5% to 11% gains for the flow-tailored pinwheel samples over their controls, also shows lower rates of deterioration by varying amounts. That is, the 45° pinwheel sample converts nearly 20% more than its control sample after 450 aging hours. Therefore, it thus can be seen that the pinwheel flow deflectors of the present invention, by distributing the flow more evenly across the entrance face 28 of the catalytic converter substrate 38, provide for a more improved efficiency of the catalytic converter over a longer period of use or aging time.

The specific examples set forth in Table I were obtained on a 1971 Ford 351 in$^3$ engine with a two barrel carburetor and standard distributor. The engine was supplied with standard mounts and coupled with a water-brake dynamometer. Load was applied to the engine by fluid resistance of the water-brake dynamometer. The engine was provided with a standard 2 inch diameter exhaust pipe, which through a wide angle diffuser of about 70°, was connected to a 5 inch diameter converter. In fact the engine exhausted into two converters mounted in parallel exhaust legs, one converter having a catalyzed monolith with a particular pinwheel flow deflector, and the second leg containing a control sample of a monolith similar in every respect, but without a deflector. Exhaust from both engine banks was brought together and then split, assuring identical exhaust conditions for comparison of the test converters during the aging process. Matching pairs of square-celled ceramic honeycombs were used as the substrates in the test program with all samples being coated with a noble metal catalyst and having an open frontal area of about 74%. The samples had a diameter of approximately 4 ⅝ inches and a length of approximately 3 inches, providing a total volume of about 50 cubic inches.

Although we have disclosed the now preferred embodiments of our invention, it will be apparent to those skilled in the art that various changes and modifications may be made thereto without departing from the spirit and scope thereof as defined in the appended claims.

We claim:

1. In an exhaust system including an exhaust pipe of one diameter, a housing of a larger diameter containing a catalyst substrate, and a frustoconical diffuser member having an entrance opening adjacent said exhaust pipe and an exit opening adjacent said housing, said diffuser member connecting said exhaust pipe and said

TABLE I

| | STEADY STATE CONVERSION EFFICIENCIES | | | | | | | |
|---|---|---|---|---|---|---|---|---|
| | HC | CO | HC | CO | HC | CO | HC | CO |
| | 0 Hours | | 149 Hours | | 371 Hours | | 450 Hours | |
| 30° PINWHEEL | 91.7 | 98.9 | 87.2 | 99.8 | 81.7 | 98.7 | 85.8 | 98.8 |
| CONTROL | 80.4 | 93.4 | 79.2 | 94.1 | 75.1 | 94.0 | 76.6 | 95.4 |
| | 0 Hours | | 150 Hours | | 275 Hours | | 450 Hours | |
| 45° PINWHEEL | 91.4 | 99.6 | 84.0 | 99.4 | 81.2 | 98.0 | 82.1 | 98.1 |
| CONTROL | 81.4 | 95.9 | 77.4 | 94.2 | 71.3 | 92.2 | 62.4 | 83.3 |

housing together wherein said exhaust pipe, diffuser and housing are axially aligned along and disposed about a common central axis, the improvement comprising deflector means positioned across the entrance opening of said diffuser for distributing the flow of exhaust gases emanating from said exhaust pipe into said housing, said deflector means including a central core portion positioned substantially coaxial with said central axis extending through said exhaust pipe, diffuser, and housing; means extending from said core portion for deflecting exhaust gases entering said diffuser angularly away from said central axis and for forming a velocity profile within said housing such that an annular area concentrically remote from said central axis has a greater velocity than that along said central axis; said deflecting means including a plurality of stationary vanes extending radially outwardly from said central core portion; said vanes being twisted with a desired angle relative to a plane extending through said core portion perpendicular to said central axis for imparting a swirl-like flow to exhaust gases passing therethrough; and means for fixably mounting said deflector in position.

2. Apparatus as defined in claim 1 wherein said vanes define an angle of about 30° with said plane passing through said core portion perpendicular to said central axis.

3. Apparatus as defined in claim 1 wherein said vanes define an angle of about 45° with said plane passing through said core portion perpendicular to said central axis.

4. Apparatus as defined in claim 1 wherein said vanes define an angle of about 60° with said plane passing through said core portion perpendicular to said central axis.

* * * * *